US007537207B2

(12) United States Patent
Kutzer et al.

(10) Patent No.: US 7,537,207 B2
(45) Date of Patent: May 26, 2009

(54) DEVICE FOR SINGULATING VERTICALLY POSITIONED FLAT MAILINGS FROM A STACK OF MAIL

(75) Inventors: Oliver Kutzer, Radolfzell (DE); Hauke Lübben, Radolfzell (DE); Michael Schwarzbauer, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 120 days.

(21) Appl. No.: 10/577,201

(22) PCT Filed: Oct. 27, 2004

(86) PCT No.: PCT/EP2004/012111

§ 371 (c)(1),
(2), (4) Date: Mar. 2, 2007

(87) PCT Pub. No.: WO2005/042386

PCT Pub. Date: May 12, 2005

(65) Prior Publication Data

US 2007/0252321 A1 Nov. 1, 2007

(30) Foreign Application Priority Data

Oct. 30, 2003 (DE) ..... 103 50 623

(51) Int. Cl.
*B65H 5/00* (2006.01)
*B65H 1/02* (2006.01)

(52) U.S. Cl. ..... 271/34; 271/10.03; 271/150; 271/270; 271/259

(58) Field of Classification Search ..... 271/34, 271/259, 258.01, 265.01, 270, 10.03
See application file for complete search history.

(56) References Cited

U.S. PATENT DOCUMENTS

| | | | | |
|---|---|---|---|---|
| 3,981,493 | A * | 9/1976 | Klappenecker et al. | 271/10.05 |
| 4,077,620 | A | 3/1978 | Frank et al. | |
| 4,171,130 | A * | 10/1979 | Jeschke et al. | 271/10.03 |
| 4,691,912 | A * | 9/1987 | Gillmann | 271/10.02 |
| 4,955,596 | A * | 9/1990 | Ricciardi | 271/110 |
| 5,074,540 | A | 12/1991 | Belec et al. | |
| 5,246,223 | A * | 9/1993 | Ricciardi et al. | 271/149 |
| 5,456,457 | A | 10/1995 | Kerstein et al. | |
| 5,494,276 | A | 2/1996 | Faber et al. | |
| 6,003,857 | A | 12/1999 | Salomon et al. | |
| 6,170,816 | B1 * | 1/2001 | Gillmann et al. | 271/10.03 |

(Continued)

*Primary Examiner*—Patrick H Mackey
*Assistant Examiner*—Luis Gonzalez
(74) *Attorney, Agent, or Firm*—Laurence A. Greenberg; Werner H. Stemer; Ralph E. Locher

(57) ABSTRACT

In a device for singulating vertically positioned flat mailings from a stack of mail, at least two discharge rockers are disposed on top of one another, wherein the discharge rockers are adjacent to revolving second discharge belts that are arranged in a fixed manner along the path of travel. A supporting element in relation to which the stack of mail is aligned ends at a defined distance from the undeflected discharge rockers. A flexible, elongated retaining element is arranged in a resiliently pressed manner from the end of the supporting element to the beginning of the second discharge belts located downstream of the discharge rockers and further on to the discharge rockers and to further discharge belts of successive singulating stages. The distance of the supporting element from the leading end of the second discharge belts relative to the direction of travel is greater than the maximum permissible length of a mailing.

8 Claims, 1 Drawing Sheet

U.S. PATENT DOCUMENTS 6,354,583 B1 * 3/2002 Skadow et al. ..... 271/10.03
6,378,859 B1 * 4/2002 Lubben et al. ..... 271/10.03
6,536,756 B2 * 3/2003 Stefan et al. ..... 271/2
6,578,839 B1 * 6/2003 Gerstenberg et al. ..... 271/10.03
6,644,659 B2 * 11/2003 Skadow et al. ..... 271/265.02
2002/0079637 A1 6/2002 Skadow et al.
2003/0168798 A1 * 9/2003 Tufekci et al. ..... 271/258.01

* cited by examiner

DEVICE FOR SINGULATING VERTICALLY POSITIONED FLAT MAILINGS FROM A STACK OF MAIL

CROSS REFERENCE TO RELATED APPLICATIONS

The present application is a national phase application of international application PCT/EP2004/012111, filed Oct. 27, 2004, and claims priority to German application 103 50 623.3, filed Oct. 30, 2003, the both of which are herein incorporated by reference.

BACKGROUND OF THE INVENTION

The invention relates to a device for singulating vertically positioned flat mailings from a stack of mail.

Until now, the singulation of different types of mailing (letters, cards/large letters, magazines, leaflets) has principally been carried out by special singulating devices. In a singulation device for letters (DE OS 26 13 261) a stack of vertical mailings is aligned in relation to a supporting element and, held on underfloor belts by a stack support, transported in the direction of the singulating stage. The singulation device has discharge rockers having revolving discharge belts, the point of rotation of said discharge rockers being located at the downstream end. A further singulation device for letters (U.S. Pat. No. 5,074,540) also has underfloor belts feeding the mailings, said underfloor belts comprising a stack support, a discharge rocker and a singulating stage. These singulation devices can process large letters only to a very restricted extent (restrictions on mailing size, thickness and condition). Singulation devices were also known for large letters (U.S. Pat. No. 5,456,457 A, U.S. Pat. No. 5,497,276 A), but these singulation devices can process standard letters only unergonomically and with a limited throughput. The device according to U.S. Pat. No. 5,497,276 A also has underfloor belts and a stack support for the stack feed. In addition, U.S. Pat. No. 6,003,857 A describes a singulating device that is suitable for mixed mail.

SUMMARY OF THE INVENTION

The object of the invention is therefore to create a device for singulating mailings which processes the two types of mailing with a high throughput and low rates of multiple discharge and damage to mailings.

Accordingly, one aspect involves a device for singulating vertically positioned flat mailings from a stack of mail. The device includes an input area, a transport section and at least one singulating stage located adjacent to the transport section and downstream relative to the direction of travel of the mailings. In the input area the stack of mail, aligned in relation to a supporting element, stands on underfloor belts and is held by at least one stack support), and the underfloor belts and the stack supports transport the stack of mail to the transport section. The transport section has at least two discharge rockers disposed on top of one another with discharge belts revolving in a driven manner, second discharge belts revolving in a driven manner that are arranged in a fixed manner adjacent thereto and downstream thereof, as well as a driven underfloor belt assigned to the discharge rockers and to the second discharge belts. A point of rotation of the discharge rockers is pressed by means of a spring force against the stack of mail. A distance sensor is assigned to each discharge rocker, wherein the distance sensor emits a drive start signal when there is a defined stack pressure on the respective discharge rocker. The singulating stage has further discharge belts revolving in a driven manner whose speed of travel is higher than the a speed of travel of the second discharge belts. The supporting element ends at a defined distance upstream of the undeflected discharge rockers. A flexible, elongated retaining element is disposed and arranged in a resiliently pressed manner from the an end of the supporting element to a beginning of the second discharge belts and further on to the discharge belts and to the discharge belts of the singulating stage. The distance of the supporting element from the downstream end of the second discharge belts relative to the direction of travel is greater than the a maximum permissible length of a mailing. A control of the drives of the transport section and of the singulating stage is fashioned such that at the defined stack pressure on the discharge rockers all the drives of the transport section and of the singulating stage are started. Further, the drives of the transport section are stopped again or are reduced in speed as soon as a mailing held by the discharge belts of the singulating stage has their speed of travel. The drives of the transport section are restarted or switched to their normal discharge speed when a gap before the subsequent mailing is detected by means of a light barrier line disposed along the path of travel.

According to the invention, at least two discharge rockers are disposed on top of one another, said discharge rockers being adjacent to revolving second discharge belts arranged in a fixed manner along the path of travel, a sensor being assigned to each discharge rocker, said sensor emitting a drive start signal when there is a defined stack pressure on the assigned discharge rocker. An underfloor belt is located upstream of the discharge rockers and the second discharge belts along the path of travel. The supporting element ends at a defined distance from the undeflected discharge rockers. A flexible, elongated retaining element is arranged in a resiliently pressed manner from the end of the supporting element to the beginning of the second discharge belts located downstream of the discharge rockers and further on to said discharge rockers and to further discharge belts of at least one singulating stage located further downstream. The distance of the supporting element from the leading end of the second discharge belts relative to the direction of travel is greater than the maximum permissible length of a mailing. The control of the underfloor belt and discharge belt drives is fashioned such that the drives are started when there is a defined stack pressure on the discharge rockers and the drives are stopped again or reduced in speed as soon as the mailing held in the singulating stage located downstream of the second discharge belts has the higher speed of travel of these discharge belts compared with that of the second discharge belts. After a gap before the subsequent mailing, detected by means of a light barrier line arranged along the direction of travel, has emerged, the drives of the discharge rockers and of the second discharge belts are restarted or are switched to their normal discharge speed.

The singulation of the frontmost mailings is therefore not carried out until said mailings are free of compressive forces from the entire stack. This prevents the compressive forces being exerted by the entire stack of mail from continuing to act on the mailing to be singulated at the point of transition to the second discharge belts. The retaining force being exerted against the direction of travel of the mailings by the retaining element can therefore be minimized. This is a prerequisite for a singulation process that protects mailings. By detecting the speed of the mailings with the aid of the speed sensors, the subsequent mailings are stopped at the earliest possible point in time, i.e. the gap is generated as early as possible.

Advantageous embodiments of the invention are set forth in the subclaims.

In order to increase the pressure of the mailings on the discharge belts and thus also the carrying force, low-pressure chambers are advantageously arranged behind the second discharge belts and the discharge belts of the further singulating stages, said low-pressure chambers pulling the mailings on to the discharge belts while they are being transported.

In order for the mailings to be transferred safely from the second discharge belts to the downstream singulating stage, the low pressure of the low-pressure chambers of the downstream singulating stage is advantageously greater than the low pressure of the low-pressure chambers of the second pressure belts.

In order to determine at low cost the speeds of mailings in the singulation process, it is advantageous to provide stationary scanning rollers or belts.

Where mailings are in a tilted position close to the discharge rockers, it is advantageous, in order to eliminate the tilted position at low stack pressure, to arrange between the underfloor belts of the input area and the underfloor belt running along the direction of travel an uprighting device with controllably driven friction belts which, when a tilted position of the leading part of the stack is identified by means of the deflection of the discharge rockers, can be driven in such a manner that the leading part of the stack is uprighted.

Since stapled mailings, e.g. open magazines, are very susceptible to damage, it is advantageous to arrange a metal sensor for detecting staples at the transition between discharge rocker and second discharge belts, said metal sensor, on detecting a staple, emitting a signal to the drive control which responds thereto with a reduction of the discharge speeds and accelerations until the mailing with the staple has left the singulating device including all singulating stages.

It is also advantageous if the speed of travel of the underfloor belt is less than that of the discharge belts of the discharge rocker. It can in this way be ensured that even where the frontmost mailing is set back somewhat relative to the subsequent mailing in the stack the frontmost mailing will reach the second discharge belts first.

It is furthermore advantageous if the point of rotation of the discharge rockers is located on the drive axis at the downstream end relative to the direction of discharge.

BRIEF DESCRIPTION OF THE SEVERAL VIEWS OF THE DRAWING

The invention will be described below in an exemplary embodiment with reference to the drawing.

The Figure shows a schematic top view of the singulating device.

DETAILED DESCRIPTION OF THE INVENTION

Figure 1:
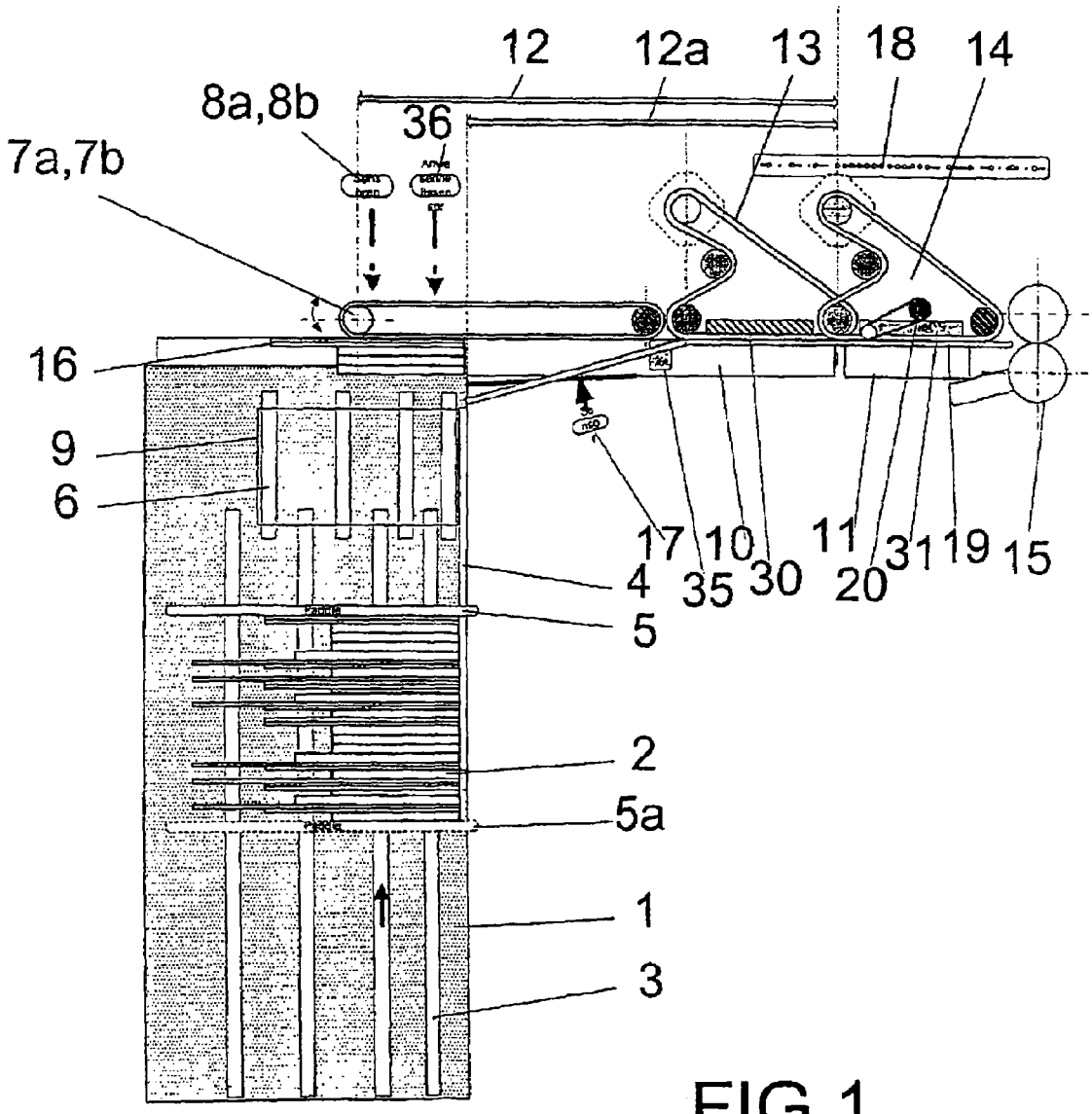

The stack of mail 2 aligned vertically on the lower edges of the mailings in the input area 1, furthermore aligned on the front-facing leading edges by a supporting element 4 and held by two stack supports 5,5*a*, stands on underfloor belts 3.

When the device is started, the stack of mail 2 is transported by the underfloor belts 3 and the stack supports 5,5*a* to friction belts 6 of an uprighting device 9. On initial loading, the friction belts 6 run synchronously with the underfloor belts 3 and carry the stack of mail 2 in the direction of the discharge rockers 7*a*,7*b* until said discharge rockers 7*a*,7*b* have reached their working position, i.e. until a defined stack pressure has deflected the discharge rockers 7*a*,7*b* by a specified amount against a spring force. This working position is detected by distance sensors 8*a* and 8*b*. After the working position of the discharge rockers 7*a*,7*b* has been reached and a presence sensor 36 additionally actuated for the presence of mailings, all the drives are started. These are the drives of a first underfloor belt 10 in the region of the discharge rockers 7*a*,7*b* and of the second discharge belts 13 located downstream, of an underfloor belt 11 of a singulating stage 14, of the discharge belts of the discharge rockers 7*a*,7*b*, of the second discharge belts 13, of the discharge belts of the singulating stage 14 and of transfer rollers 15.

The leading area of the stack of mail which is located on the underfloor belt 10 is transported along the discharge rockers 7*a*,7*b* and the second discharge belts 13 to the singulating stage 14. The frontmost mailing 16 of the stack of mail is additionally transported by the drive belts of the two discharge rockers 7*a*,7*b*, which run faster than the underfloor belt 10. This ensures that the frontmost mailing 16 reaches the singulating stage 14 as the first mailing even where the leading edge is set back relative to the subsequent mailing. A flexible, elongated retaining element 19 runs in a resiliently pressed manner from the end of the supporting element 4 to the beginning of the second discharge belts 13 located downstream of the discharge rockers 7*a*,7*b* and further on to said discharge rockers 7*a*,7*b* and to the discharge belts of the singulating stage 14 located downstream.

The underfloor belt 10 is stopped or greatly reduced in speed upon actuation of a sensor 17 which reports when the space upstream of the discharge rockers 7*a*,7*b* is filled with mailings. The transport section 12 (discharge rockers 7*a*,7*b* and second discharge belts 13) is now filled by an uneven flow of mailings.

The length of the transport section 12*a* (distance of the supporting element 4 from the leading end of the second discharge belts 13 relative to the direction of travel) must be greater than the maximum permissible length of a mailing. This prevents the compressive forces being exerted by the entire stack of mail from continuing to act on the mailing to be singulated at the point of transition to the singulating stage 14. The retaining force being exerted against the direction of travel of the mailings by the retaining element 19 can therefore be minimized. This is a prerequisite for a singulation process that protects mailings.

The speed of the discharge belts of the singulating stage 14 is higher than that of the discharge belts of the discharge rockers 7*a*,7*b* and of the coupled second discharge belts 13. As soon as the frontmost mailing has reached the higher speed of the singulating stage 14, the transport section [lacuna] discharge rockers 12 is stopped. The detection of the speed of the mailing is carried out by a motion sensor 20, in which a scanning roller runs over the mailing and measures its speed. The frontmost mailing is now held securely by the transport belts of the singulating stage 14. The transporting effect of the discharge belts downstream of the discharge rockers 7*a*,7*b* is supported by low-pressure chambers 30,31.

The removal of the first mailing against the subsequent flow of mail (at a standstill in the transport section 12) produces a gap in the area of the transition to the singulating stage 14, said gap being detected by a light barrier line 18. As soon as the desired distance to the subsequent mailing is reached, the transport section 12 can be restarted. The majority of the gaps are generated with this device at the transition from transport section 12 to singulating stage 14.

The underfloor belts 10 and 111 additionally support the transport of heavy mailings in the entire singulation area. The underfloor belt 11 runs at a significantly lower speed than the discharge belts of the singulating stage 14 and has a comparatively low coefficient of friction in relation to the lower edge of the mailing traveling on it.

The discharge rockers 7*a*,7*b* are two rockable arms disposed on top of one another which can be pushed into their working position independently of one another by the pressure of the stack of mail.

In continuous operating mode, the discharge rockers 7*a*,7*b* exert a permanent spring force on the stack of mail 2 to be singulated.

Mailings which are not vertically positioned at the discharge rockers 7*a*,7*b* cause a variably wide deflection of the two discharge rockers 7*a*,7*b*. Analysis by the distance sensors 8*a*,8*b* can record how heavily and in what direction the upcoming mailings are tilted. The tilted position of the mailings to be discharged is determined by means of a differential measurement by the distance sensors 8*a*,8*b*. If the tilt is inadmissibly large, the leading area of the stack of mail 2 is corrected by means of an uprighting device 9. The friction belts 6 of the uprighting device 9, which are capable of running both forwards and backwards, exert a pressure or a braking force on the bottom edge of the stack of mail. As a result of the discharging of the frontmost mailings 16, the position of the discharge rockers 7*a*,7*b* changes relative to the direction of the stack of mail 2.

The compensatory conveyance of the stack of mail 2 by the underfloor belts 3 and the stack supports 5,5*a* is also controlled by means of the distance sensors 8*a*,8*b*. When a thick mailing 16 is discharged, the gap in the stack produced as a result is absorbed by the movement of the rockers. The feeding of the stack of mail 2 can thus be carried out with limited dynamic change. The resulting stack compression forces are considerably lower.

A metal sensor 35 for detecting staples is arranged in the region of the underfloor belt 10. This metal sensor 35 serves to identify stapled mailings (e.g. open magazines). Since stapled mailings are particularly susceptible in terms of damage, after a staple has been detected the speeds of the discharge belts and the acceleration at the transition of the transport section 12 to the singulating stage 14 are reduced. This means that after detecting this critical type of mailing the device automatically switches to a more mail-protective mode until this mailing has left the device. Although this leads to a reduction in throughput for this type of mailing, it does enable the automatic processing of mailings which could previously be processed only manually.

The invention claimed is:

1. Device for singulating vertically positioned flat mailings from a stack of mail, comprising:

an input area, a transport section and at least one singulating stage located adjacent to the transport section and downstream relative to the a direction of travel of the mailings, wherein in the input area the stack of mail, aligned in relation to a supporting element, stands on underfloor belts and is held by at least one stack support, and the underfloor belts and the stack supports, at transport the stack of mail to the transport section, wherein the transport section comprises at least two discharge rockers disposed on top of one another with discharge belts revolving in a driven manner, second discharge belts revolving in a driven manner that are arranged in a fixed manner adjacent thereto and downstream thereof, as well as a driven underfloor belt assigned to the discharge rockers and to the second discharge belts, wherein a point of rotation of the discharge rockers is pressed by means of a spring force against the stack of mail, wherein a distance sensor is assigned to each discharge rocker, said distance sensor emitting a drive start signal when there is a defined stack pressure on the respective discharge rocker, wherein the singulating stage comprises further discharge belts revolving in a driven manner whose speed of travel is higher than a speed of travel of the second discharge belts, wherein the supporting element ends at a defined distance upstream of the undeflected discharge rockers, wherein a flexible, elongated retaining element is disposed, said retaining element being arranged in a resiliently pressed manner from an end of the supporting element to a beginning of the second discharge belts and further on to said discharge belts and to the discharge belts of the singulating stage, wherein a distance from an end of the supporting element to the downstream end of the second discharge belts relative to the direction of travel is greater than a maximum permissible length of a mailing, and wherein a control of drives of the transport section and of the singulating stage is fashioned such that at the defined stack pressure on the discharge rockers all the drives of the transport section and of the singulating stage are started, the drives of the transport section are stopped again or are reduced in speed as soon as a mailing held by the discharge belts of the singulating stage has their speed of travel, and the drives of the transport section are restarted or switched to their normal discharge speed when a gap before the subsequent mailing is detected by means of a light barrier line disposed along the path of travel.

2. Device according to claim 1, wherein low-pressure chambers are disposed behind the second discharge belts and the discharge belts of the further singulating stages, said low-pressure chambers pulling the mailings on to the discharge belts during travel.

3. Device according to claim 2, wherein a low-pressure of the low-pressure chambers of the second discharge belts is less than a low-pressure of the low-pressure chambers of the singulating stage located downstream.

4. Device according to claim 1, wherein stationary scanning rollers or belts running on the mailings are provided for determining mailing speeds.

5. Device according to claim 1, wherein an uprighting device with controllably driven friction belts is disposed between the underfloor belts of the input area and the underfloor belt running along the path of travel, said friction belts being drivable such that, when a tilt in a leading part of the mailing stack is identified by means of deflection of the discharge rockers, the leading part of the mailing stack is uprighted.

6. Device according to claim 1, wherein a metal sensor for detecting staples is disposed at a transmission between discharge rockers and second discharge belts, said metal sensor emitting, when a staple is detected, a signal to a drive control which responds thereto by reducing a discharge speeds and accelerations until the mailing with the staple has left the singulating device including all singulating stages.

7. Device according to claim 1, wherein a speed of travel of the underfloor belt is lower than that of the discharge belts of the discharge rockers.

8. Device according to claim 1, wherein the point of rotation of the discharge rockers is located at their downstream end on the drive axis.

* * * * *